US007430835B1

(12) United States Patent
Larson

(10) Patent No.: US 7,430,835 B1
(45) Date of Patent: Oct. 7, 2008

(54) DOOR AND FRAME FOR AIR HANDLING UNIT

(75) Inventor: Steven V. Larson, Minneapolis, MN (US)

(73) Assignee: A.J. Manufacturing, Inc., Bloomer, WI (US)

( * ) Notice: Subject to any disclaimer, the term of this patent is extended or adjusted under 35 U.S.C. 154(b) by 787 days.

(21) Appl. No.: 09/517,974

(22) Filed: Mar. 3, 2000

(51) Int. Cl.
*E06B 1/04* (2006.01)

(52) U.S. Cl. ..... 52/204.1; 49/400; 52/793.1

(58) Field of Classification Search ..... 49/400, 49/489.1, 475.1, 495.1; 52/204.1, 793.1, 52/793.11

See application file for complete search history.

(56) References Cited

U.S. PATENT DOCUMENTS 2,910,209 A * 10/1959 Nelson ..... 220/378
2,935,771 A * 5/1960 Hatcher ..... 49/493.1
3,040,393 A * 6/1962 Dailey ..... 227/630
3,332,170 A * 7/1967 Bangs ..... 49/400
3,374,580 A * 3/1968 Ruff ..... 49/482.1
3,684,342 A * 8/1972 Jansen ..... 312/406.2
3,685,206 A * 8/1972 Kessler ..... 49/489.1
3,818,655 A * 6/1974 Carter ..... 52/79.7
4,502,249 A * 3/1985 Banford ..... 49/381
4,538,380 A * 9/1985 Colliander ..... 49/475.1
5,007,202 A * 4/1991 Guillon ..... 49/441
5,107,622 A * 4/1992 Fuchs et al. ..... 49/484.1
5,172,519 A * 12/1992 Cooper ..... 49/400
5,305,969 A * 4/1994 Odell et al. ..... 244/129.5
5,414,961 A * 5/1995 Tessier ..... 49/441
5,467,764 A * 11/1995 Gamow ..... 128/202.12
5,560,154 A * 10/1996 Matarazzo ..... 49/484.1
5,581,951 A * 12/1996 Ryan et al. ..... 49/498.1
5,711,706 A * 1/1998 Griffin et al. ..... 454/338
5,791,408 A 8/1998 Seem
5,921,043 A * 7/1999 McDonald ..... 52/309.9

OTHER PUBLICATIONS

Temtrol Catalog, pp. 1-25, Jan. 1998.

* cited by examiner

*Primary Examiner*—Gregory J. Strimbu
(74) *Attorney, Agent, or Firm*—Gerald E. Helget; Nelson R. Capes; Briggs and Morgan, P.A.

(57) ABSTRACT

A door and frame combination for an air handling unit consists of a frame, a hinged door with a hollow core filled with insulating material, and a gasket having a flexible gasket wall with anti-roll extensions. The gasket may have a friction-reducing material on its surface to assist in preventing roll-over by the closing door. Optional thermal pockets in the door and frame are filled with high-density polyurethane to provide further protection against air leakage.

4 Claims, 6 Drawing Sheets

DOOR AND FRAME FOR AIR HANDLING UNIT

BACKGROUND OF THE INVENTION

Many commercial buildings have air handling units, usually placed on the roof of the building. An air handling unit of the prior art is generally shown in FIG. 1.

As can be seen, a typical air handling unit includes an enclosure E with one or more doors D to allow personnel to gain access to the machinery inside the enclosure.

The air handling unit enclosure typically encloses heating, ventilation and air conditioning equipment (HVAC). Because the HVAC equipment is used to maintain the building's temperature, it is important that the enclosure E and doors D of the air handling unit do not allow the passage of air into or out of the air handling unit.

Because of this requirement, the air handling unit must be able to withstand the high external air pressure associated with gale force winds. Furthermore, the air pressure inside the air handling unit is typically lower than ambient air pressure outside the unit (sometimes by as much as six inches), and such a difference in air pressure can cause a pressure differential between the inside and outside of the unit equivalent to up to a 300 mph wind blowing against the unit and its doors. The doors must not leak air, even under such a high pressure.

In addition, the doors of the unit must have thermal insulation to prevent heat exchange between the outside and the inside of the unit.

Typical air handling units of the prior art are capable of withstanding six inches of pressure differential, but this is their limit.

In today's environment, there is a need for high-efficiency cooling in buildings. Such high-efficiency cooling requires a more efficient air handling unit, because colder air within the air handling unit means that less volume of air conditioned air is needed to maintain the building's temperature.

There is a need for a high-efficiency air handling unit with higher structural strength and more efficient thermal properties.

SUMMARY OF THE INVENTION

A door and frame combination for an air handling unit, the combination comprising:

(a) a frame;

(b) a hinged door engaging the frame, the door further comprising a front wall, rear wall, and side walls enclosing a hollow core and insulating material filling the hollow core; and (c) a gasket between the door and the frame, the gasket further comprising a flexible gasket wall with anti-roll extensions.

A principal object and advantage of the present invention is that it provides higher structural strength with less door thickness than in previous doors.

Another principal object and advantage of the present invention is that it includes a special gasket which does not roll over when the door closes, thus producing an airtight seal.

DETAILED DESCRIPTION OF THE PREFERRED EMBODIMENTS

Figure 1:
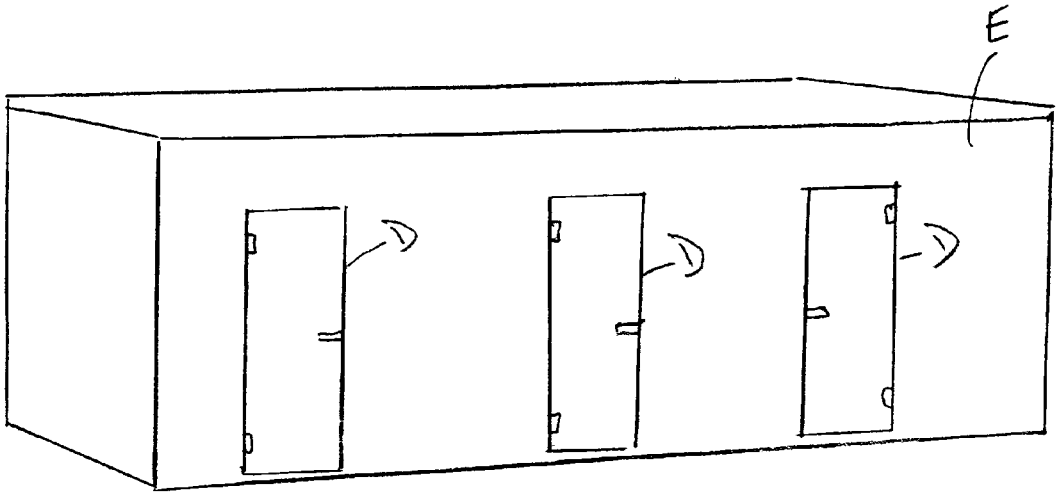
FIG. 1 (PRIOR ART)
FIG. 1 is a perspective view of an air handling unit of the prior art.
Figure 2:
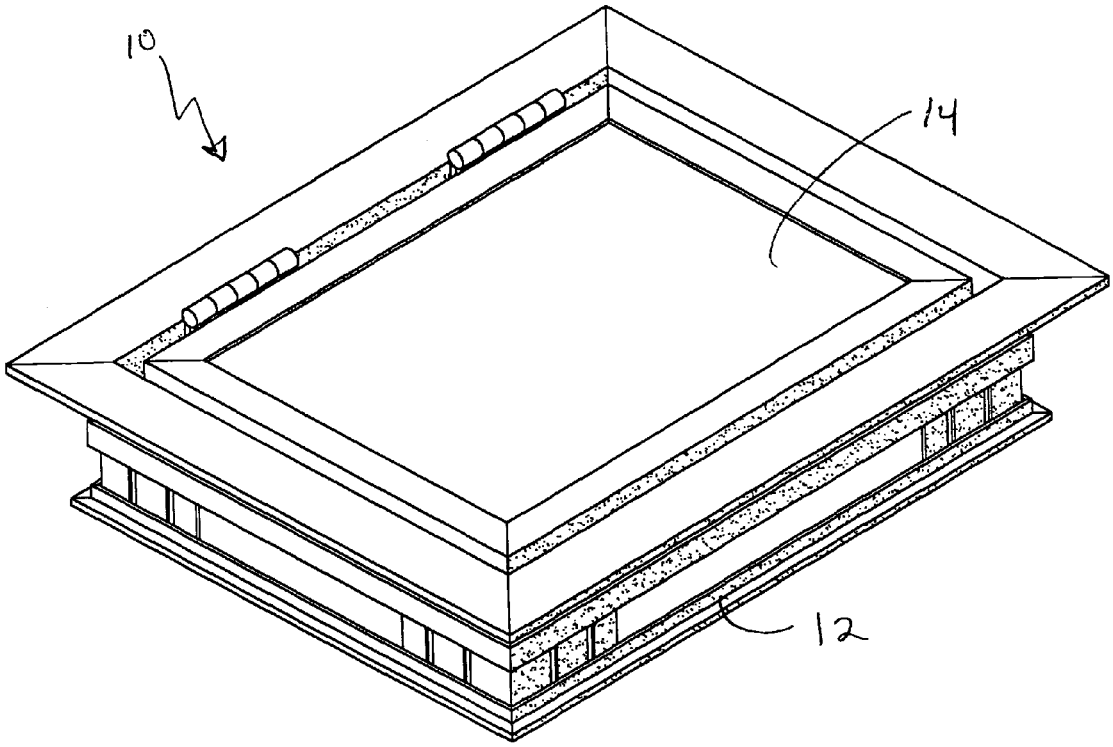
FIG. 2 is a perspective view of the door and frame of the present invention.
Figure 3:
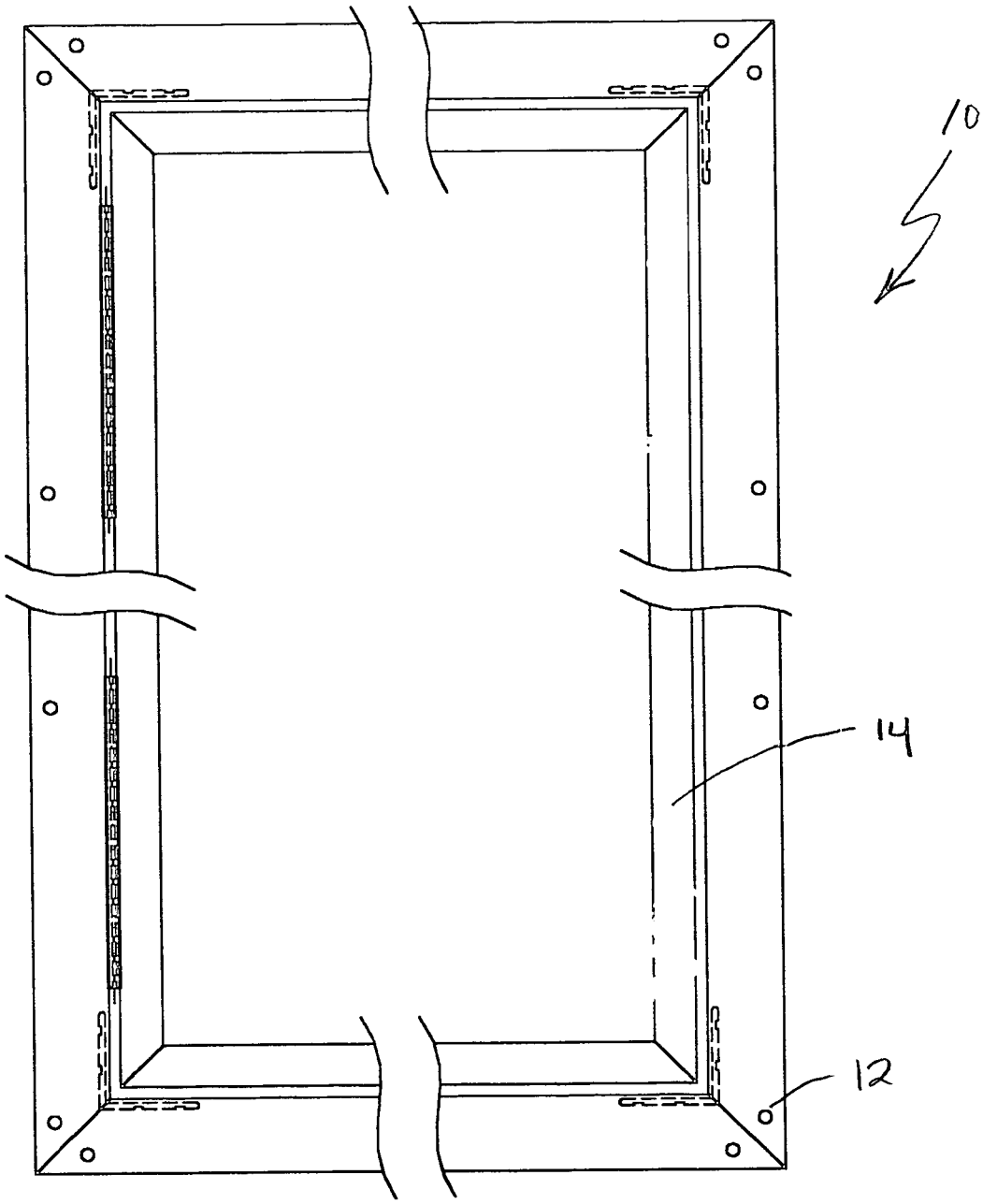
FIG. 3 is an elevational view of the door and frame of the present invention.
Figure 4:
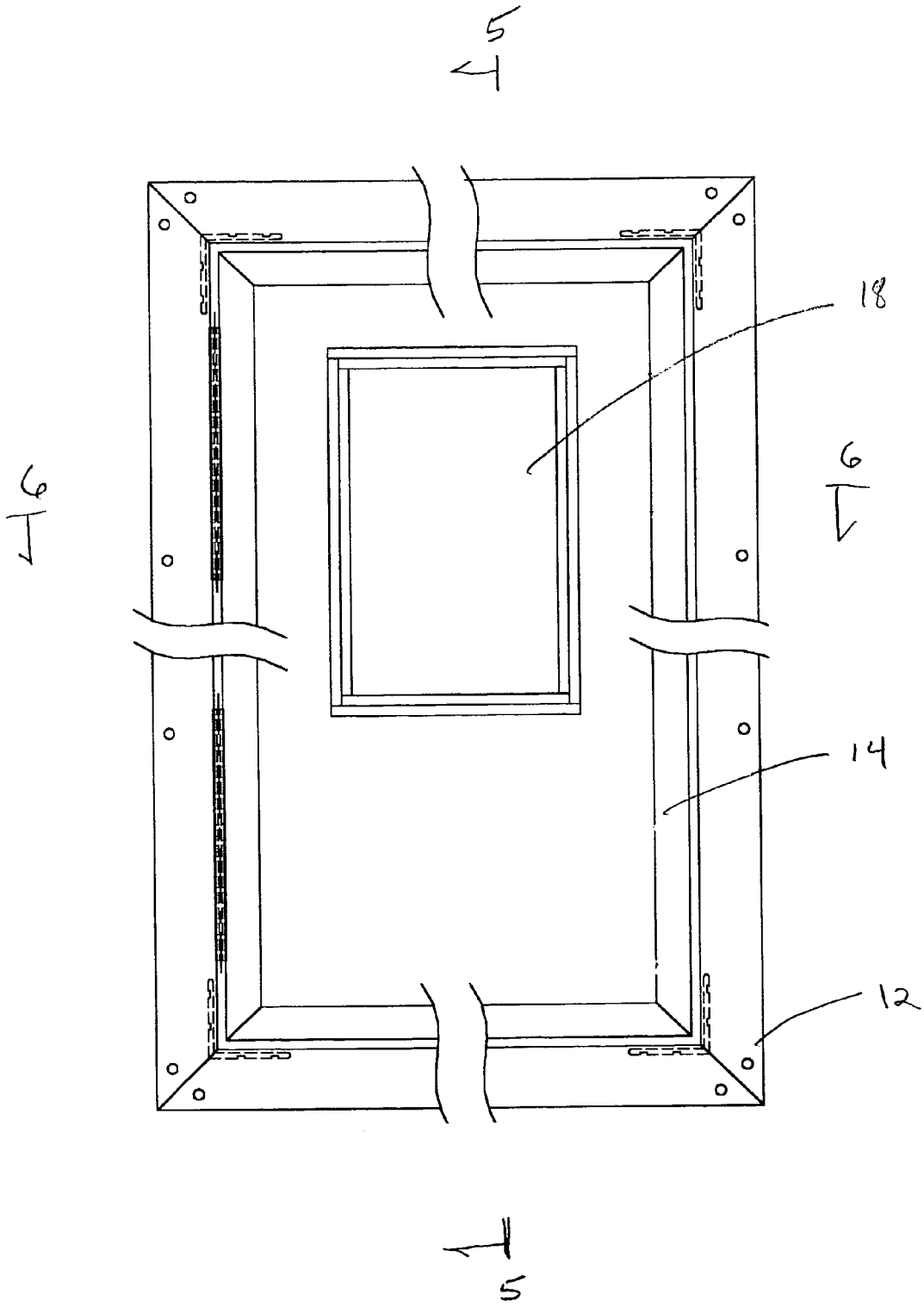
FIG. 4 is the same as FIG. 3, but also showing an optional window.

The door and frame combination of the present invention is generally shown in the Figures as reference numeral 10.

The door and frame combination 10 comprises a frame 12; a hinged door 14 engaging the frame 12; and a gasket 16 between the door 14 and the frame 12. Optionally, the door may have a window 18 therein.

Figure 5:
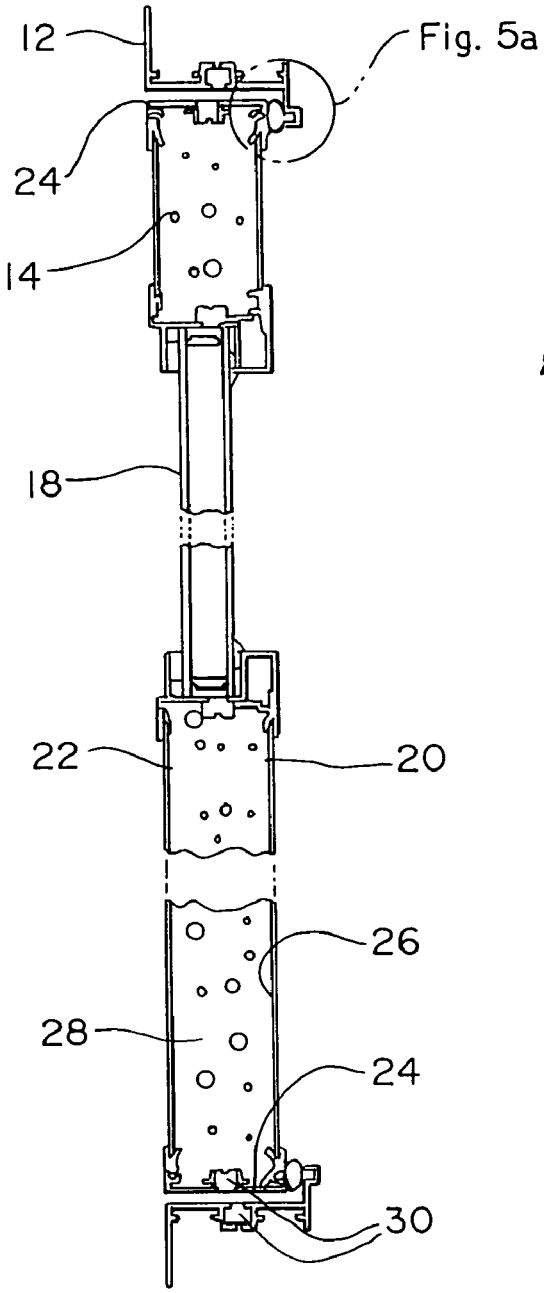
FIG. 5 is a cross-section along the lines 5 of FIG. 4.
Figure 5A:
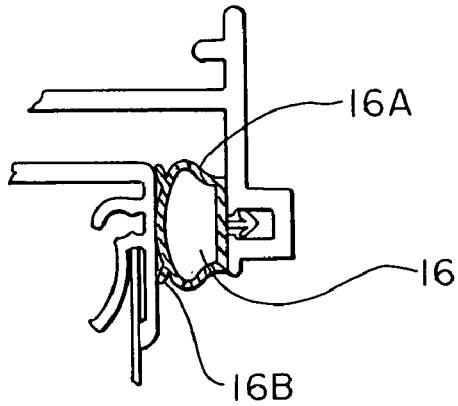
Figure 6:
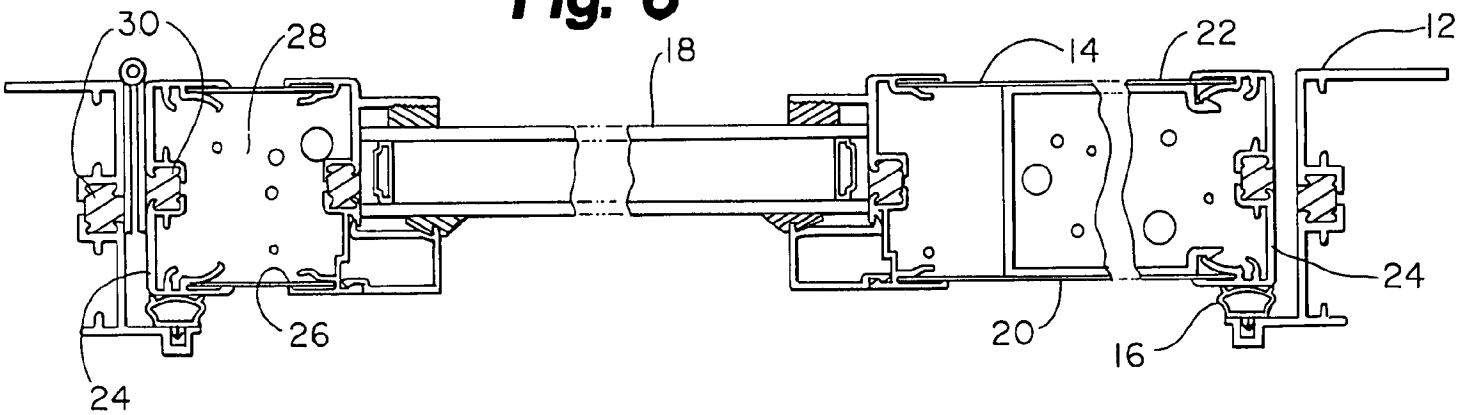
FIG. 6 is a cross-section along the lines 6 of FIG. 4.

As may be more particularly seen in FIGS. 5 and 6, the door 14 further comprises a front wall 20, rear wall 22, and side walls 24 enclosing a hollow core 26. The hollow core 26 is filled with insulating material 28.

Preferably the insulating material 28 is expanding polyurethane foam. This foam may be obtained readily from several sources, such as Flexible Products Company, 1007 Industrial Park Drive, Marietta, Ga. 30062, whose product is a polymeric diphenylmethane diisocyanate with chlorodifluoromethane.

In the preferred embodiment, the side walls 24 are two inches in width, to produce a door 14 two inches thick.

Figure 7:
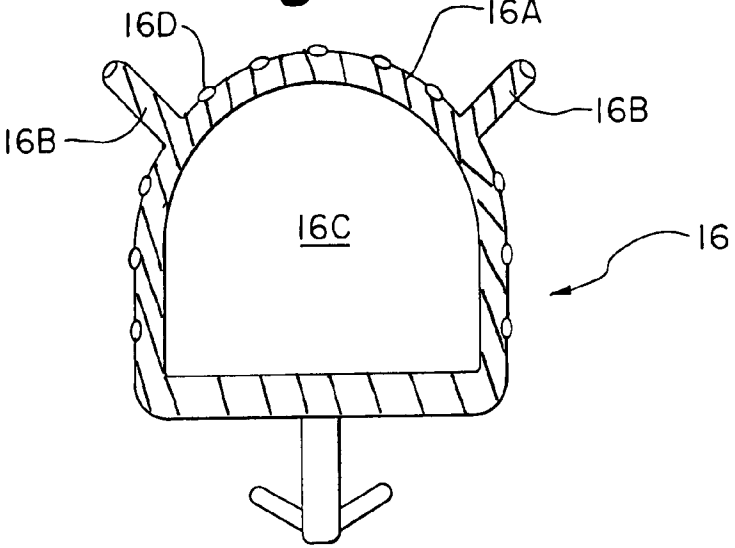
FIG. 7 is a cross-section of the gasket of the present invention.

As can best be seen in FIGS. 5 and 7, the gasket 16 comprises a gasket wall 16A with anti-roll extensions 16B. Preferably, the gasket 16 has a hollow core 16C within the gasket wall 16A.

Preferably, the gasket has a friction-reducing material 16D on the gasket wall 16A. The friction-reducing material may be SANTOPRENE® thermoplastic rubber from Advanced Elastomer Systems, L.P., 388 South Main St., Akron, Ohio 44311; a thermoplastic resin from Minnesota General Polymers, 3500 W. Highway 13, Burnsville, Minn. 55337 (a propylene-ethylene copolymer); and Pro-Fax polymer (propylene-ethylene copolymer) from Himont, Inc., Three Little Falls Center, 2801 Centerville Rd., Wilmington, Del. 19850.

To produce additional protection against leakage of air around the door, the door 14 and frame 12 may have thermal pockets 30 filled with an insulating material, such as high-density polyurethane.

As the door 14 is closed against the frame 12, the anti-roll extensions 16B on the gasket 16 prevent the gasket from being rolled over by the door. This property is assisted by the friction-reducing material 16D on the gasket wall 16A. The result is that the gasket 16 is flattened between the door 14 and the frame 12, producing an air-tight seal.

If R13 polyurethane insulation is used within the hollow core 26 of the door 14, the door need only be two inches thick, rather than four inches, as in previous doors in air handling units. The polyurethane insulation also gives the door 14 rigidity and structural strength. The polyurethane insulation is applied as an expanding foam while the door is under pressure during the manufacturing process. It has been found that approximately eight minutes is required to keep the door under pressure to prevent undue expansion of the foam, followed by twenty-four hours of curing.

The door and frame combination has been tested at up to 14 inches of static pressure without leaking, as compared to six inches of static pressure for previous doors.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A hinged door and frame in combination with an air handling unit fixedly mounted on a fixed structure, the combination comprising:

(a) the hinged door engageable with the frame, the door further comprising a front wall, rear wall, and side walls enclosing a hollow core and insulating material filling the hollow core; wherein the insulating material is expanding polyurethane foam; and (b) a gasket between the door and the frame, the gasket further comprising a flexible gasket wall with anti-roll extensions, and further comprising a friction reducing material on the gasket wall;

(c) opposed thermal pockets in the door and in the frame, the thermal pockets being filled with high-density polyurethane; and wherein the door and frame can withstand a pressure differential of greater than eleven inches of air pressure.

2. The door and frame combination of claim 1 wherein the gasket further comprises a central hollow core.

3. The door and frame combination of claim 1, further comprising a window in the door.

4. The door and frame combination of claim 1, wherein the side walls are two inches in width.

* * * * *